US011696606B2

(12) United States Patent
Inselberg et al.

(10) Patent No.: US 11,696,606 B2
(45) Date of Patent: Jul. 11, 2023

(54) ATHLETIC BRA

(71) Applicant: Under Armour, Inc., Baltimore, MD (US)

(72) Inventors: Ofra Inselberg, Baltimore, MD (US); Maxi Roberts, Toronto (CA); Jessica LaCava, Baltimore, MD (US); Abby Wittstadt, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 165 days.

(21) Appl. No.: 17/113,458

(22) Filed: Dec. 7, 2020

(65) Prior Publication Data

US 2021/0169153 A1 Jun. 10, 2021

Related U.S. Application Data

(60) Provisional application No. 62/944,459, filed on Dec. 6, 2019.

(51) Int. Cl.
*A41C 3/00* (2006.01)

(52) U.S. Cl.
CPC ..... *A41C 3/0085* (2013.01); *A41C 3/0014* (2013.01); *A41C 3/0057* (2013.01); *A41C 3/0035* (2013.01)

(58) Field of Classification Search
CPC ..... A41C 5/005
See application file for complete search history.

(56) References Cited

U.S. PATENT DOCUMENTS

| | | | | | |
|---|---|---|---|---|---|
| 162,869 | A | * | 5/1875 | Tallman | A41C 3/144 450/57 |
| D87,112 | S | | 6/1932 | Greig | |
| D90,517 | S | | 8/1933 | Tournier | |
| D125,662 | S | * | 3/1941 | Katz | D2/707 |
| 2,524,028 | A | * | 10/1950 | Bordner | A61F 2/52 623/7 |
| 2,570,352 | A | | 10/1951 | La Roe et al. | |
| 2,579,365 | A | * | 12/1951 | Conde | A41C 3/10 D2/706 |

(Continued)

FOREIGN PATENT DOCUMENTS

| | | |
|---|---|---|
| CN | 301909942 | 5/2012 |
| CN | 303291896 | 7/2015 |

(Continued)

OTHER PUBLICATIONS

Women's UA Infinity Low Sports Bra, available at underarmour.com, earliest customer review date Sep. 2019 [online], [site visited Sep. 15, 2021], available at Internet URL: https://www.underarmour.com/en-us/p/sports-bras/womens-ua-infinity-high-sports-bra/1351994.html (Year: 2019).

(Continued)

*Primary Examiner* — Jocelyn Bravo
(74) *Attorney, Agent, or Firm* — Edell, Shapiro & Finnan, LLC

(57) ABSTRACT

An athletic bra includes a support panel shaped to include first and second cups. Grooves are formed into the panel to provide areas of increase flexure and/or stretch. A textile layer can be secured to the support panel.

20 Claims, 7 Drawing Sheets

(56) References Cited

U.S. PATENT DOCUMENTS 2,659,085 A * 11/1953 Ericson ..... A41C 3/0014 450/39
2,696,004 A 12/1954 Schaumer
2,748,771 A * 6/1956 Richards ..... A41C 3/04 450/36
2,755,004 A * 7/1956 Schumacher ..... D06F 59/02 223/66
2,781,518 A * 2/1957 Verreault ..... A41C 3/00 450/90
2,793,369 A * 5/1957 Panighini ..... A41C 3/065 D2/706
2,797,415 A * 7/1957 Spanel ..... A41C 3/0014 450/39
2,891,544 A * 6/1959 London ..... A61F 13/141 604/377
2,892,459 A 6/1959 Rosenthal
D186,375 S 10/1959 Schaumer
3,008,468 A 11/1961 Williams
3,077,196 A * 2/1963 Paxton ..... A41C 3/00 450/82
3,085,723 A * 4/1963 Vanderburg ..... D06F 59/02 223/66
3,400,720 A 9/1968 Ward
3,494,365 A * 2/1970 Beals ..... A41C 3/00 450/55
3,527,858 A 9/1970 Braxton et al.
4,481,951 A * 11/1984 Cole ..... B29C 51/145 29/445
4,566,458 A * 1/1986 Weinberg ..... A41C 3/14 128/890
4,607,640 A * 8/1986 McCusker ..... A41C 3/0057 450/1
4,926,503 A * 5/1990 Wingo, Jr. ..... A63B 71/12 2/463
5,032,103 A * 7/1991 Larsson ..... A61J 13/00 450/38
5,301,370 A * 4/1994 Henson ..... A63B 71/1225 2/24
D364,250 S * 11/1995 McCracken ..... D29/100
5,769,688 A * 6/1998 Holliday ..... A41C 3/0057 450/55
5,951,367 A * 9/1999 Hsu ..... A41C 3/144 2/455
6,027,396 A * 2/2000 Yonchar ..... A41C 3/10 450/36
6,083,080 A * 7/2000 Lawson ..... A41C 3/10 450/39
6,110,005 A * 8/2000 Stephenson ..... A41C 3/10 450/39
6,145,134 A * 11/2000 Davis ..... A41D 13/0518 2/463
D439,027 S * 3/2001 Randolph ..... D2/706
6,296,545 B1 * 10/2001 Chen ..... A41C 3/0092 450/38
6,299,505 B1 10/2001 Huang
6,302,760 B1 * 10/2001 Dai ..... A41C 3/105 450/38
6,306,006 B1 * 10/2001 Cheng ..... A41C 3/10 450/57
6,332,825 B1 12/2001 Henricksen
6,375,537 B1 * 4/2002 Jankowski ..... A63B 71/12 2/463
6,398,620 B1 6/2002 Huang
6,406,352 B1 * 6/2002 Cheng ..... A41C 3/144 450/55
6,431,945 B1 * 8/2002 Stephens ..... A41C 3/10 450/37
6,517,410 B1 * 2/2003 Underhill ..... A41C 3/0057 450/1
6,540,585 B1 * 4/2003 Lee ..... A41C 3/10 450/55
6,659,841 B2 * 12/2003 Raimondo ..... A41C 3/04 450/36
6,688,942 B2 * 2/2004 Holliday ..... A41C 3/142 450/39
D491,091 S 6/2004 Osinga
6,811,463 B2 * 11/2004 Martz ..... A41C 3/10 450/38
6,883,179 B1 * 4/2005 Crum ..... A41D 1/22 2/105
6,921,316 B1 * 7/2005 Jian ..... A41C 3/105 450/38
7,081,034 B1 * 7/2006 Zoellner ..... A41C 3/04 2/104
7,442,110 B2 * 10/2008 Gaudet ..... A41C 3/144 450/39
7,517,273 B2 4/2009 Wooten
7,585,200 B1 * 9/2009 McLaren ..... A41C 3/0035 450/1
7,731,564 B2 * 6/2010 Sanders ..... A41C 1/003 450/39
7,739,753 B2 * 6/2010 Jankowski ..... A41C 3/0057 2/92
7,814,569 B2 * 10/2010 Di Lorenzo ..... A41D 7/00 2/67
7,833,082 B2 11/2010 Bugada
D628,768 S * 12/2010 Fei ..... D2/706
8,128,457 B2 * 3/2012 Reinisch ..... A41C 3/0057 450/59
8,517,794 B2 * 8/2013 Thompson ..... A41B 17/00 450/92
8,628,507 B1 * 1/2014 Carroll ..... A61F 13/141 604/346
8,656,515 B2 2/2014 Newton et al.
8,915,764 B2 12/2014 Scott et al.
8,956,199 B2 * 2/2015 Liu ..... A41C 3/146 450/38
D746,543 S * 1/2016 McClain ..... D2/731
D752,844 S 4/2016 Martinet et al.
9,468,236 B1 * 10/2016 Sherry ..... A41C 3/105
9,516,905 B2 12/2016 Pagnon
9,560,886 B2 * 2/2017 Luxi ..... A41C 3/06
9,596,892 B1 * 3/2017 Komas ..... A41C 3/0092
D791,432 S 7/2017 Lee
9,801,421 B2 10/2017 Turner
9,913,498 B2 3/2018 Ichiba et al.
9,943,120 B1 * 4/2018 Rendone ..... A41C 3/0014
10,028,540 B2 7/2018 Shearer
10,051,896 B2 8/2018 Miller et al.
10,104,925 B2 10/2018 Farmer et al.
10,117,785 B2 * 11/2018 Marquez ..... A61F 13/141
10,123,575 B2 * 11/2018 Funk-Danielson .... A41C 3/128
10,231,492 B1 * 3/2019 Bastug ..... A41C 3/10
10,448,679 B1 * 10/2019 Roddis ..... A41C 3/0057
10,466,017 B1 * 11/2019 Childers ..... D05B 93/00
10,492,544 B2 * 12/2019 McKeen ..... A41C 3/06
10,660,377 B2 * 5/2020 Randall ..... A41C 3/14
10,681,940 B2 * 6/2020 Castelazo ..... A47C 20/02
2003/0027492 A1 * 2/2003 Roffidal ..... A41C 3/142 450/57
2003/0181129 A1 * 9/2003 Getman ..... A41C 3/0057 450/57
2005/0266770 A1 12/2005 Henricksen
2006/0166601 A1 * 7/2006 Chen ..... A41C 3/144 450/57
2007/0026766 A1 * 2/2007 Gimble ..... A41C 3/12 450/39
2007/0155283 A1 * 7/2007 McQueer ..... A41C 3/0057 450/39
2007/0281586 A1 * 12/2007 Pritchard ..... A41C 3/08 450/37
2008/0026676 A1 * 1/2008 Rothman ..... A41C 3/08 450/36
2008/0076324 A1 3/2008 Liu
2008/0090491 A1 * 4/2008 Liu ..... A41C 3/122 450/39
2008/0194180 A1 * 8/2008 Warren ..... B29C 65/086 450/86

(56) References Cited

U.S. PATENT DOCUMENTS

| | | | | |
|---|---|---|---|---|
| 2009/0203295 | A1* | 8/2009 | Kassel | A41C 3/04 604/385.07 |
| 2010/0015886 | A1* | 1/2010 | Waitz | A41C 3/10 450/86 |
| 2010/0267312 | A1* | 10/2010 | Chien | A41C 3/144 450/38 |
| 2011/0111674 | A1 | 5/2011 | Padula | |
| 2012/0046627 | A1* | 2/2012 | Agnew | A61F 13/141 604/358 |
| 2012/0064799 | A1* | 3/2012 | Rivers | A41C 3/0035 450/86 |
| 2012/0094575 | A1* | 4/2012 | Sokolowski | A41C 5/005 450/92 |
| 2012/0149277 | A1* | 6/2012 | Moses-Jones | A41C 3/0028 450/75 |
| 2012/0208434 | A1 | 8/2012 | Chang | |
| 2012/0225257 | A1* | 9/2012 | Noda | B32B 5/04 264/138 |
| 2014/0073221 | A1* | 3/2014 | Liu | A41C 3/12 450/39 |
| 2015/0118937 | A1* | 4/2015 | Wan | A41C 3/0085 450/92 |
| 2017/0119063 | A1* | 5/2017 | Diaz | A41C 3/0014 |
| 2017/0290376 | A1* | 10/2017 | Maheshwari | D04B 21/207 |
| 2018/0132541 | A1* | 5/2018 | Wittstadt | A41C 3/0057 |
| 2018/0132542 | A1* | 5/2018 | Abbaszadeh | A41C 3/04 |
| 2018/0344487 | A1* | 12/2018 | Mommers-McCaffrey | A41B 1/08 |
| 2019/0000154 | A1* | 1/2019 | Liu | B32B 3/30 |
| 2019/0125007 | A1* | 5/2019 | Liu | A41C 5/005 |
| 2019/0174841 | A1* | 6/2019 | Bastug | A41C 3/0007 |
| 2019/0380641 | A1 | 12/2019 | Nong et al. | |
| 2019/0390024 | A1 | 12/2019 | Negi et al. | |
| 2020/0060356 | A1* | 2/2020 | Trangmar | A41C 3/142 |
| 2020/0085112 | A1* | 3/2020 | Roddis | A41C 3/0057 |
| 2020/0085113 | A1* | 3/2020 | Rendone | A41C 3/0035 |
| 2020/0109496 | A1 | 4/2020 | Lucas et al. | |
| 2020/0214367 | A1* | 7/2020 | Kobayashi | A41C 3/10 |
| 2020/0237027 | A1* | 7/2020 | Morris | A41C 3/0057 |
| 2020/0397069 | A1* | 12/2020 | Liu | A41C 3/142 |
| 2021/0169153 | A1 | 6/2021 | Inselberg et al. | |
| 2021/0337885 | A1* | 11/2021 | Connor | A41C 3/0064 |
| 2022/0183400 | A1* | 6/2022 | Moylan | A41C 3/0028 |

FOREIGN PATENT DOCUMENTS

| | | | | |
|---|---|---|---|---|
| CN | 303831130 | | 9/2016 | |
| CN | 305697815 | | 4/2020 | |
| CN | 306525419 | | 5/2021 | |
| CN | 306645960 | | 6/2021 | |
| CN | 306749278 | | 8/2021 | |
| CN | 306814198 | | 9/2021 | |
| GB | 2411099 | | 8/2005 | |
| GB | 9007337373-0003 | | 12/2019 | |
| SG | 2008466Z-0001 | | 4/2008 | |
| WO | 2019161533 | A1 | 8/2019 | |
| WO | WO-2019161533 | A1 * | 8/2019 | A41C 3/10 |

OTHER PUBLICATIONS

Review, available at insider.com, earliest date available Apr. 8, 2020 [online], [site visited Sep. 15, 2021], available at Internet URL: https://www.insider.com/under-armour-infinity-sports-bra-review (Year: 2020).

8, available at dribbble.com, earliest date available May 6, 2019 [online], [site visited Sep. 15, 2021], available at Internet URL: https://dribbble.com/damiankidd/projects/1217191-36-Days-of-Type-2019 (Year: 2019).

Eight, available at alamy.com, earliest date available Feb. 1, 2018 [online], [site visited Sep. 15, 2021], Internet URL: https ://www.alamy.com/ set-of-eight-minimalistic-trendy-shapes-stylish-vector-logo-emblems-for-your-design-simple-geometric-signs-collection-image22770 6398.html (Year: 2018).

Pearl and Crystal Barrette, available at snapdeal.com, date not available [online], [site visited Sep. 15, 2021], available at Internet URL: https://www.snapdeal.com/product/pearl-and-crystal barrette-in/636114425801.

Figure Eight Study No. Eleven, available at fineartamerica.com, earliest date available Sep. 18, 2011 [online], [site visited Sep. 15, 2021], available at Internet URL: https://fineartamerica.com/featured/figure-eight-study-number-eleven-michael-morgan.html (Year: 2011).

Double Infinity Necklace, available at kay.com, date not available [online], [site visited Sep. 15, 2021], available at Internet URL: https://www.kay.com/double-infinity-necklace-18-ct-tw-diamonds-sterling-silver/pN-173281801#.

* cited by examiner

ATHLETIC BRA

CROSS-REFERENCE TO RELATED APPLICATION

This application claims priority from U.S. Provisional Patent Application Ser. No. 62/944,459, filed Dec. 6, 2019 and entitled "Athletic Bra", the disclosure of which is incorporated herein by reference in its entirety.

FIELD

The present invention relates to an article of apparel for a torso and, in particular, to an athletic bra.

BACKGROUND

Brassieres or bras are worn by many women to support their breasts and to facilitate a desirable shape and appearance. During athletic activities such as running, excessive breast motion can lead to discomfort and even potential damage to breast anatomy. Accordingly, bras are made with a variety of constructions to provide different amounts of support to different areas of the breasts. Conventional athletic bras provide support by restricting motion via compression or encapsulation. Compression bras apply uniform pressure to flatten the breasts against the chest. Encapsulation bras have a cup for each breast, usually with an underwire, that separates the breasts and holds them in place. These approaches, while generally effective, are focused on limiting all movement. As a result, conventional bras may cause discomfort via the increased pressure applied by the garment or by the underwire pressing into the wearer. It would be desirable to provide an athletic bra capable of providing fit and motion control without one or more of the above noted drawbacks.

BRIEF SUMMARY OF THE INVENTION

In example embodiments, an article of apparel such as an athletic bra comprises a single or unitary support panel of molded material defining a first panel side, a second panel side, and a perimetral edge. The panel includes a first cup and a second cup, the first cup forming a first cup convex section at the first side and a first cup concave section at the second side, and the second cup forming a second cup convex section at the first side and a second cup concave section at the second side. A groove is formed into the second panel side and extends continuously along the second panel side from the first cup concave section to the second cup concave section, where the groove defines a flexure zone for the athletic bra.

In further example embodiments, an athletic bra includes a monolithic or unitary panel or pad spanning both breasts. The panel includes a topography configured to direct motion of the breasts during athletic activities such as running. The topography includes an ordered arrangement of valleys and ridges. The valleys define flexure lines that encourage motion (e.g., flexure and/or stretch of the pad), while the ridges resist motion. The valleys and ridges may be organized within the panel to direct and/or control breast motion.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION OF THE INVENTION

In the following detailed description, reference is made to the accompanying figures which show, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Figure 1A:
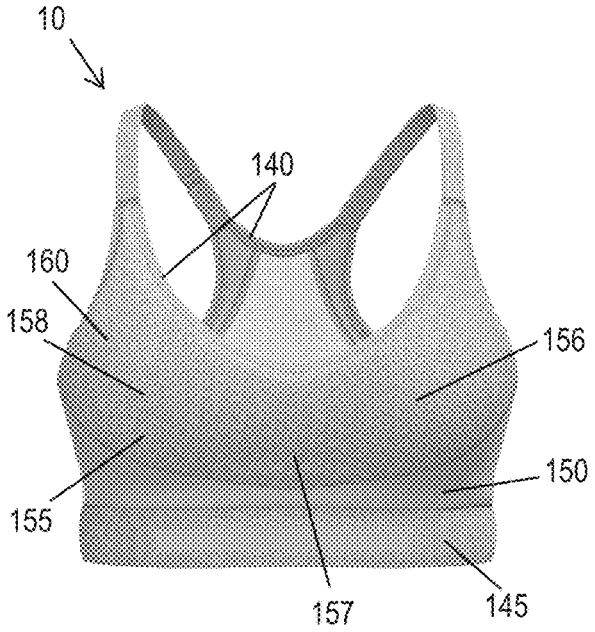
FIG. 1A is a front view of an athletic bra including a support panel in accordance with an embodiment of the invention.
Figure 1B:
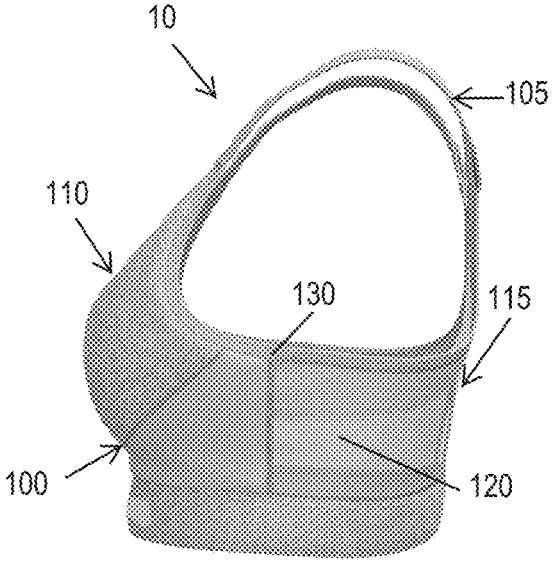
FIG. 1B is a left-side view of the athletic bra shown in FIG. 1A.
Figure 1C:
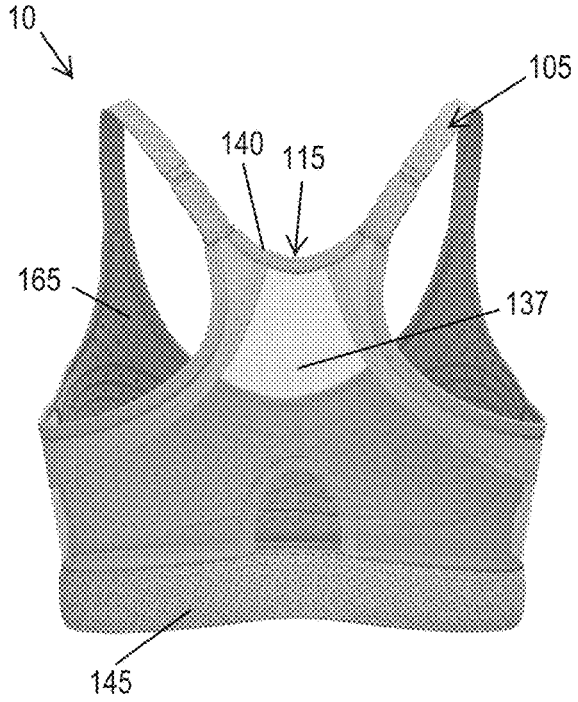
FIG. 1C is a rear view of the athletic bra shown in FIG. 1A.
Figure 1D:
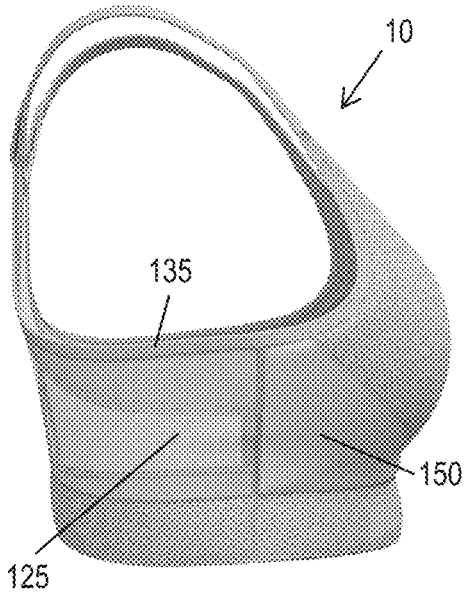
FIG. 1D is a right-side view of the athletic bra shown in FIG. 1A

Referring to FIGS. 1A and 1B, athletic bra 10 includes a body 100 and a pair of shoulder straps 105 extending from a front portion 110 to a rear portion 115. The front portion 110 is configured to generally span the front of the wearer's torso, while the rear portion 115 is configured to generally span the rear of the wearer's torso. A first wing 120 is configured to span the side of the wearer (under the arm), extending from the front portion 110 to the rear portion 115. Similarly, a second wing 125 extends from the front portion 110 to the rear portion 115. The first wing 120 cooperates with the body portion to define a first arm line 130, while the second wing 125 cooperates with the body portion to define a second arm line 135. The wings transition to a back panel 137 that spans the back of the wearer. The body 100 defines an upper edge or neckline 140 along each of the front portion 110 and back panel 137.

A bottom or under band 145 extends along the bottom edge of the body 100 and is configured to encircle the torso of the wearer. The front portion 110 further includes a cradle 150 extending continuously from the first wing 120 to the second wing 125. Above the cradle 150 is a cup area 155 that continuously spans the front portion 110 and, as such, is configured to span the breasts of the wearer. The cup area 155 defines a first or left cup section 156, bridge section 157 and a second or right cup section 158, with the bridge section separating the first cup section from the second cup section. The cup area 155 includes an enclosed pocket or chamber defined by an outer textile layer 160 (e.g., a knit fabric) and an inner textile layer 165 (e.g., a knit mesh fabric).

The pocket is sufficiently dimensioned to snugly receive and retain a pad or support panel 170 configured to support the breasts. In the embodiments illustrated, the panel 170 is a monolithic or unitary (i.e., one piece or single piece) structure configured to span the cup area 155, defining a first or front side 205 and a second or rear side 210 (the rear side faces the wearer). The panel 170 possesses a three-dimensional shape, including a perimeter or perimetral edge defining a bottom edge 215A, first 215B and second 215C lateral or side edges in communication with the lateral ends of the bottom edge, first arm hole edge 215D and second arm hole edge 215E, and a neckline edge 215F. The neckline edge 215F and the first arm hole edge 215D form an upward extending first or left tab 220A, while the neckline edge 215F and the second arm hole edge 215E form an upward extending right or second tab 220B.

The support panel 170 further includes a first or left cup 225 separated from a second or right cup 230 by a central gore or bridge 232. Each of the left cup 225 and right cup 230 possesses a generally convex shape along the front (outward-facing) side 205 and a complimentary or inverse, generally concave shape along the rear (wearer-facing) side 210. The left 225 and right 230 cups of the support panel 170 are further suitably dimensioned and oriented along the support panel such that, when the support panel is secured within the pocket defined by the outer textile layer 160 and the inner textile layer 165 of the body 100, the left and right cups are suitably oriented with the respective left and right breasts of the wearer.

The support panel 170 may be formed of a compression material such as a thermoplastic elastomer or other polymer foam (e.g., an open cell polymer foam). Polymer foams include polyurethane foam, polyolefin foam, and ethylene vinyl acetate (EVA) foam, as well as an EVA foam blended with one or more of an EVA modifier, a polyolefin block copolymer, and a triblock copolymer, and a polyether block amide. In an embodiment, the foam is polyurethane foam.

The support panel 170 may be formed via compression molding or injection molding. In compression molding, a cured blank of foam is placed into a mold, where it is shaped under heat and pressure to take the form of the mold. In injection molding, uncured foam is injected into a mold cavity, where it expands and cures into the shape provided by the mold. For example, a mold including a convex mold portion and a concave mold portion that, when closed, cooperate to define cavity that corresponds to the shape of the one-piece support panel 170. The mold portions may further include protrusions or recesses organized in a predetermined pattern configured to form recesses and protrusions, respectively, in the support panel (discussed in greater detail, below). Liquid foam material is injected into the cavity, where the foam expands and cures.

The dimensions of the support panel 170 may be any suitable for its described purpose. By way of example, the thickness of the support panel 170 may be approximately 4 mm to 8 mm, e.g., about 6 mm.

The front side 205 and/or the rear side 210 of the panel 170 may further include a topology configured to permit and/or resist movement (e.g., expansion) within the panel and/or guide flexure of the panel. Specifically, each side 205, 210 of the support panel 170 includes one or more elongated depressions, recesses or grooves formed into the panel surface, as well as non-recessed areas or ridges between the grooves. Additionally, the surface of the support panel 170 may further include raised areas or protrusions extending from the surface of a non-recessed area. With this configuration (discussed in greater detail, below), the support panel 170 includes discrete areas of thickness, with grooves providing a first panel thickness, the non-recessed areas providing a second panel thickness that is greater than the first panel thickness, and the protrusions providing a third panel thickness greater then each of the first and second panel thicknesses.

With this configuration, areas of differing modulus or flexure zones are formed that relate to the thickness of the panel at the location. Specifically, recessed areas possess greater stretch properties than normal, non-recessed areas. Similarly, protruding areas possess less stretch than normal, non-protruding areas. The dimensions of the recesses and protrusions may be any suitable for their described purpose (e.g., to generate a desired amount of directional support for the wearer's breasts).

Figure 2A:
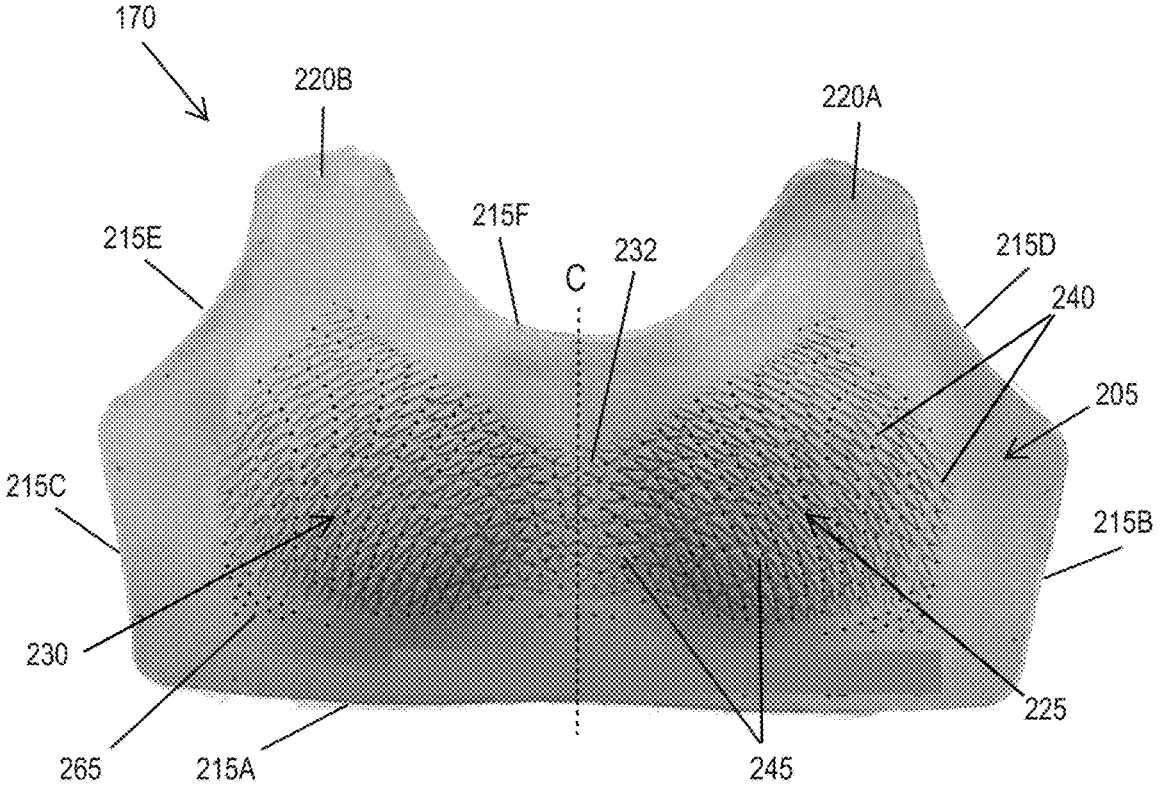
FIG. 2A is a photographic image of a front side of a bra support panel in accordance with an embodiment of the invention.
Figure 3A:
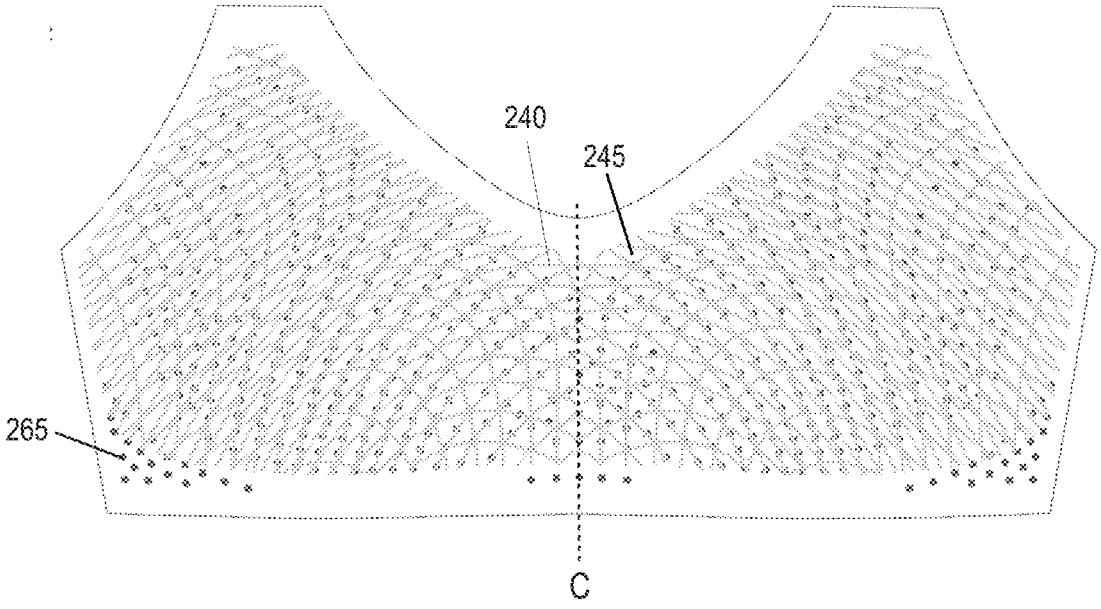
FIG. 3A is an illustrative view in plan of a front side of a bra support panel in accordance with an embodiment of the invention, showing protrusions or ridges, depressions or grooves and apertures arranged in a predetermined pattern.

Referring to FIGS. 2A and 3A, the front side 205 of the support panel 170 may include a plurality of grooves 240 arranged in a predetermined pattern to provide a predetermined fit and/or support level to the wearer. As shown, the pattern along the panel front side 205 includes arcuate or straight grooves 240 disposed about a centerline C that form a network or matrix of grooves extending upward along each of the left cup 225 and/or the right cup 230. The grooves 240 may intersect to define non-recessed or elevated areas 245 (also called islands). The elevated areas 245, whose boundaries are based upon the intersections of the grooves 240, may possess a generally polygonal shape (such as a triangular shape). In an embodiment, the groove/island pattern on the left cup 225 is a mirror image of the groove on the right cup 230; moreover, the density of the grooves 240 and/or islands 245 may be ordered in a gradient pattern, with the density of grooves and/or polygons (e.g., density per square inch) increasing along each cup from the centerline C of the support panel 170 toward the lateral side edges 215B, 215C.

Figure 2B:
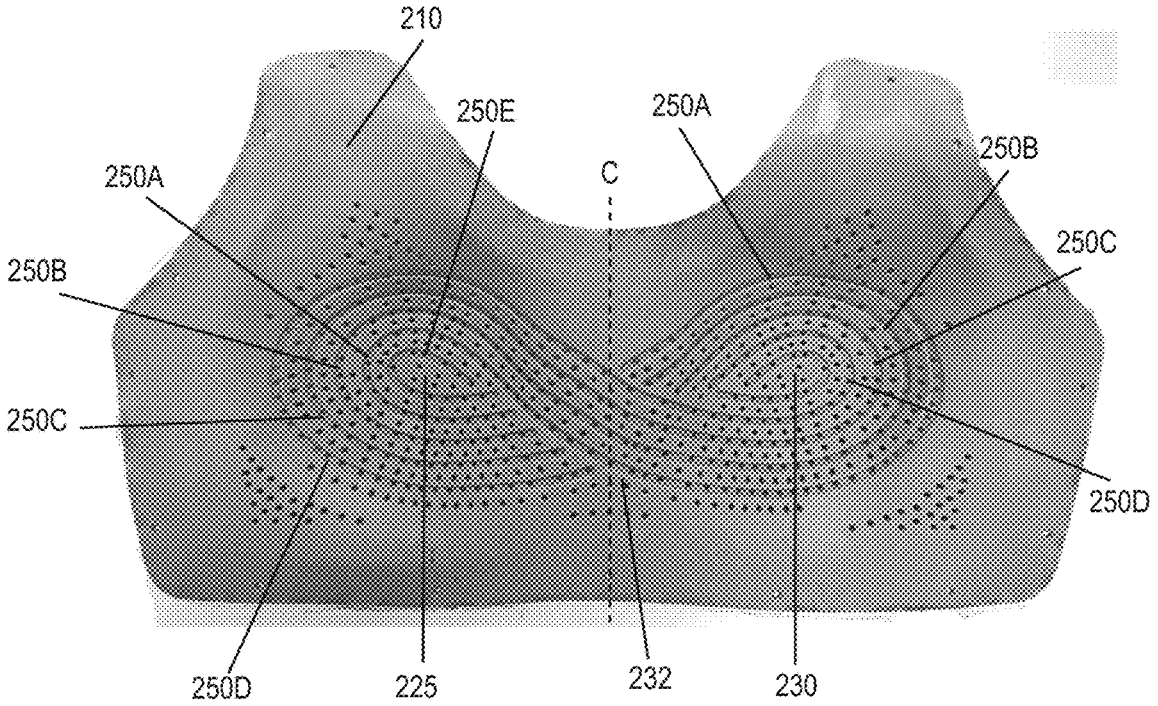
FIG. 2B is a photographic image of a rear or user-facing side of the bra support panel shown in FIG. 1A.
Figure 3B:
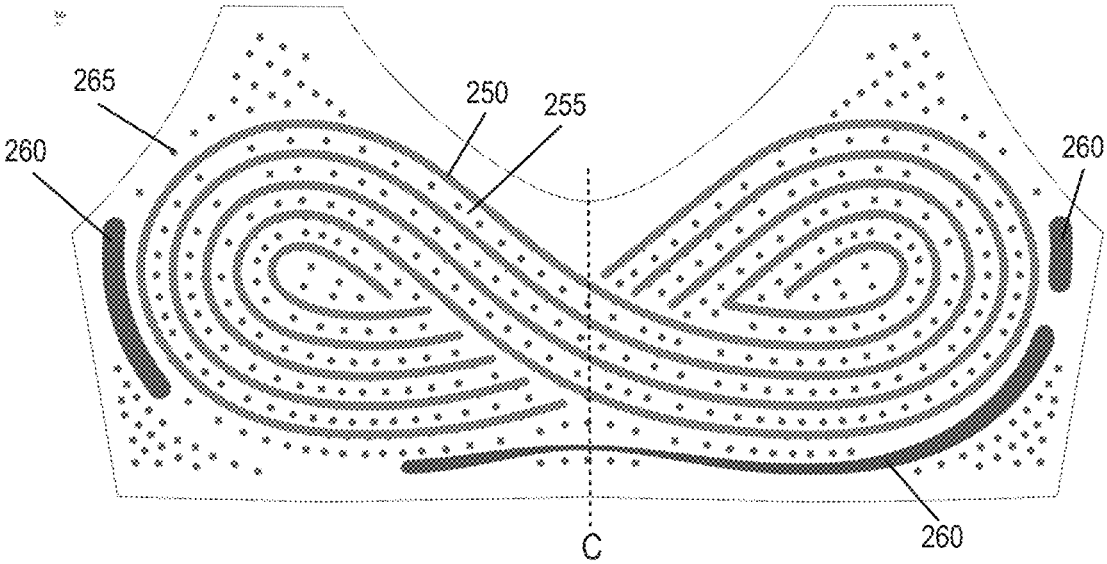
FIG. 3B is an illustrative view in plan of a rear side of a bra support panel in accordance with an embodiment of the invention, showing protrusions or ridges, depressions or grooves and apertures arranged in a predetermined pattern.
Figure 4A:
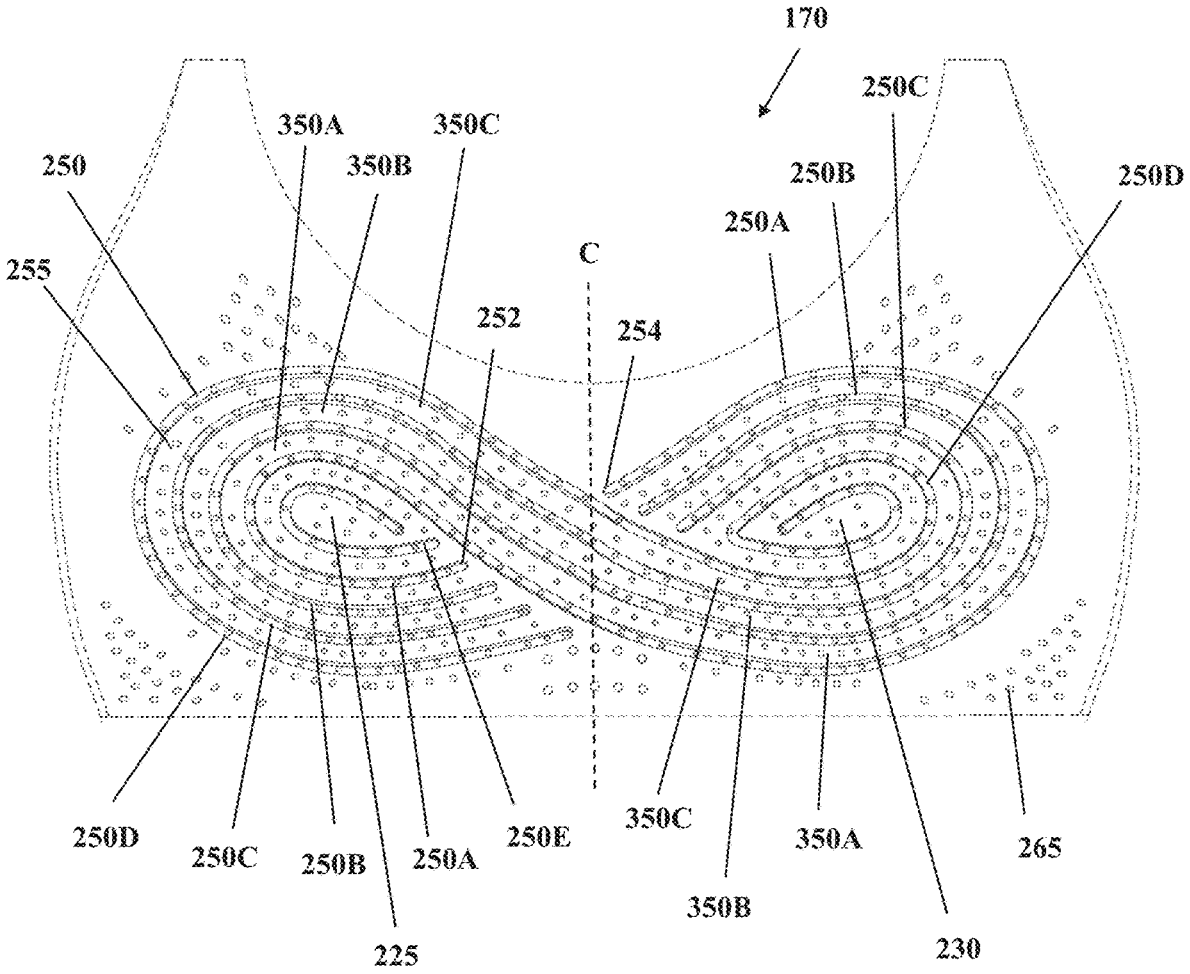
FIGS. 4A, 4B and 4C are illustrations of a rear side of a bra support panel in accordance with an embodiment of the invention (where FIG. 4A provides a view in plan of the rear side, while FIGS. 4B and 4C provide opposing perspective views of the rear side), showing protrusions or ridges, depressions or grooves and apertures arranged in a predetermined pattern.
Figure 4B:
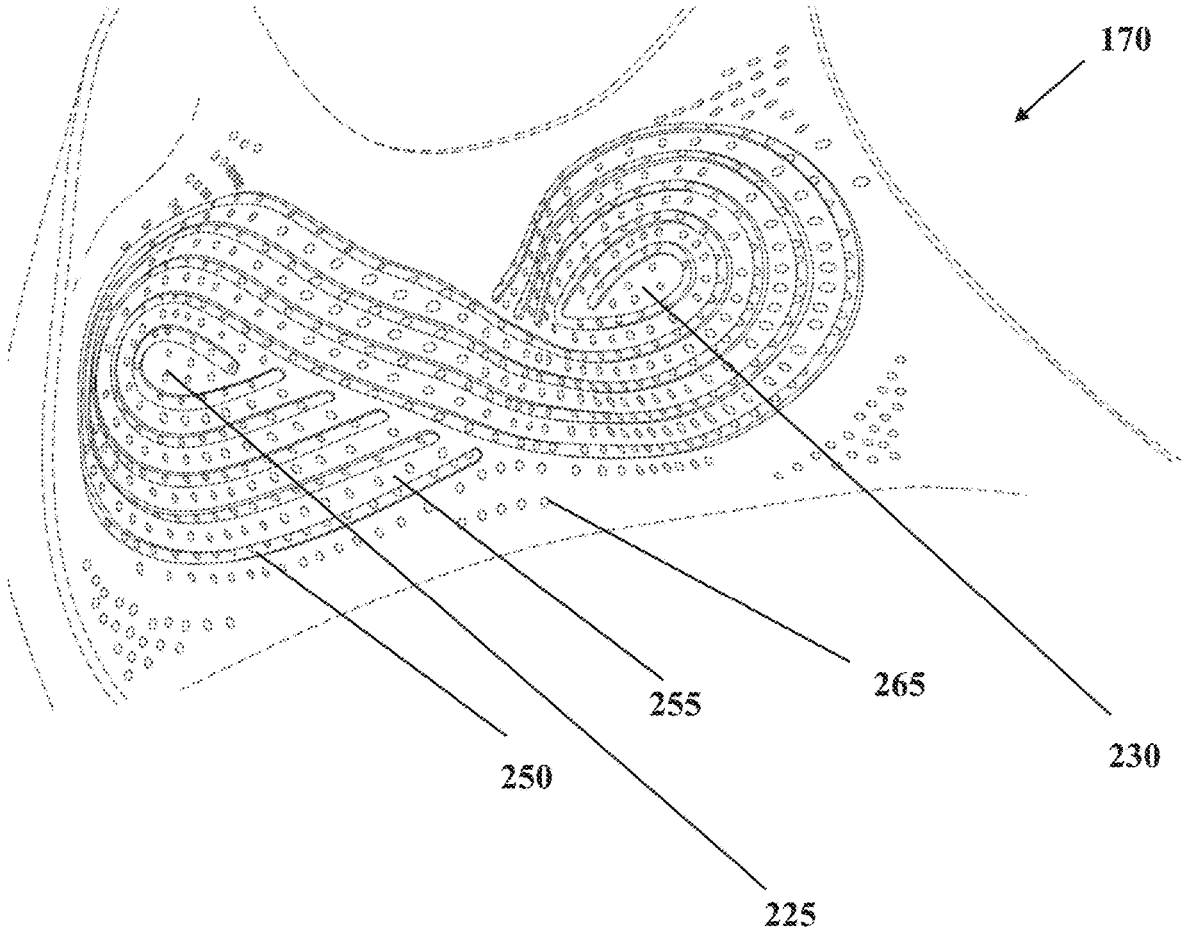
Figure 4C:
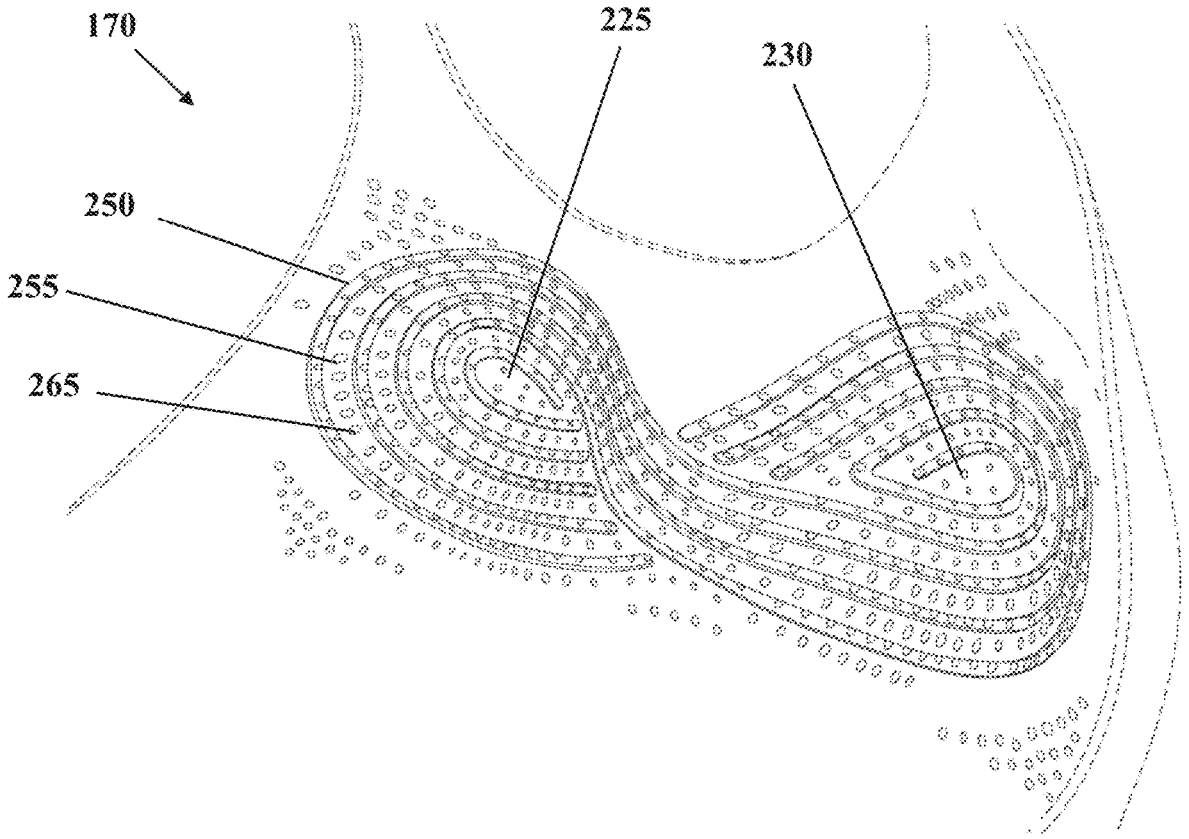

Referring to FIGS. 2B and 3B, as well as FIGS. 4A, 4B, 4C, the rear side 210 of the support panel 170 also includes a plurality of arcuate grooves 250 arranged in a predetermined patterned to provide desired contouring (fit) and/or support characteristics. As shown, the plurality of grooves 250 includes one or more grooves or recesses extending continuously from the left cup 225, across the panel centerline C and to the right cup 230. As shown, the rear side 210 includes an array of curved or arcuate grooves arranged in a predetermined pattern configured to encapsulate the breasts while permitting degrees of motion during active use. Specifically, the rear side 210 includes a first arcuate groove 250A, a second arcuate groove 250B, a third arcuate groove 250C, a fourth arcuate groove 250D, and a fifth arcuate groove 250E. The first through fourth arcuate grooves 250A-250D begin at first groove end 252 within the first or left cup 225, curve within the left cup, travel across the panel centerline C and into the second or right cup 230, curve within the right cup 230, and terminate at groove end second 254 therein. The fifth arcuate groove 250E, in contrast, may remain within the first or left cup 225. As such, a groove 250 may include multiple curved sections that alter the direction of the groove toward, e.g., the centerline C and/or the perimetral edges 215C, 215C of the support panel 170.

In the illustrated embodiment, none of the grooves 250 overlaps or intersects each other (or is interconnected). Instead, some of the grooves 250 are nested within other grooves at their arcuate or curving sections along the left cup 225 and the right cup 230. As such, each groove forms a complete or substantially complete lemniscate with figure-eight or ∞-shaped curves. In particular, each groove 250A, 250B, 250C, 250D has a shape that substantially forms but does not complete the shape of an infinity symbol or pattern (∞) with the arcuate portions of each of these grooves located at the left 225 and right 230 cup areas, where the groove includes an arcuate or curved section at each of the left and right cup areas.

The arcuate portions of the grooves 250A-250E are arranged such that they are consecutively nested within each other at each cup in the following manner. At the right cup 230, the consecutive nested arrangement of the arcuate or curved sections for the grooves from outermost to innermost groove (where the arcuate portion of the innermost groove is located at or very near a central location of the right cup) is as follows: Groove 250A (outermost groove), groove 250B, groove 250C, and groove 250D (innermost groove). At the left cup 225, the consecutive nested arrangement of the arcuate or curved sections for the grooves from outermost to innermost groove (where the arcuate portion of the innermost groove is located at or very near a central location of the left cup) is as follows: Groove 250D (outermost groove), groove 250C, groove 250B, groove 250A and groove 250E (innermost groove). Thus, the consecutive nested arrangement for grooves 250A, 250B, 250C, 250D differs and is the exact opposite in relation to the left cup 225 and the right cup 230.

The areas between the grooves 250A-250E along the rear side 210 of the panel 170 define non-recessed areas or elevated areas 255 with surfaces elevated above the groove surface. In the illustrated embodiment, none of the grooves 250A-250E at the rear side 210 of the panel 170 intersects with any other groove. Accordingly, many of the elevated areas 255 defined between grooves 250A-250E also extend continuously between and form arcuate portions at the left 225 and right 230 cup locations of the support panel 170. Referring the FIGS. 4A, 4B and 4C, the elevated areas 255 include a first elevated area or ridge 350A, a second elevated area or ridge 350B and third elevated area or ridge 350C, each of which is arcuate to define, e.g., an infinity symbol or pattern as each ridge extends between the left 225 and right 230 cups, where the ridge includes a curved or arcuate section at each of the left and right cup areas. Similar to the nested grooves, ridges 350A, 350B, 350C are also nested in relation to each other such that, at the right cup 230, the consecutive nested arrangement of the arcuate or curved sections for the ridges from outermost to innermost ridge is as follows: Ridge 350A (outermost ridge), ridge 350B and ridge 350C (innermost ridge). At the left cup 225, the consecutive nested arrangement of the arcuate or curved sections for the ridges from outermost to innermost ridge is as follows: Ridge 350C (outermost ridge), ridge 350B and ridge 350A (innermost ridge). Thus, the consecutive nested arrangement for ridges 350A, 350B, 350C, differs and is the exact opposite in relation to the left cup 225 and the right cup 230.

Referring back to FIG. 3B, the second side 210 of the panel includes a plurality of protruding areas or protrusions 260 extending upward from a non-recessed area 250.

The dimensions of the grooves 240, 250, the non-recessed areas 245, 255, and/or protrusions 260 may be any suitable for its described purpose (e.g., to generate a desired amount of contouring and/or support for the wearer's breasts). By way of example, the non-recessed areas 245, 255 may possess a thickness of about 4 mm to 8 mm (e.g., 6 mm), corresponding with general panel thickness. The recessed areas or grooves 240, 250 may possess a depth of about 1-4 mm, corresponding to a panel thickness of about 2-5 mm along the grooves. Finally, the protrusions 260 may possess a height of about 3-5 mm, corresponding to a panel thickness of about 9-11 mm. Accordingly, the support panel 170 can vary in thickness along its lengthwise and/or widthwise dimension from about 1 mm to about 11 mm.

Additionally, the width (transverse dimension) of an individual recessed area 240, 250 or a non-recessed area 245, 255 may be any suitable for its described purpose. By way of example, the width of a groove 240, 250 is about 1-3 mm, e.g., 1.5 mm. Similarly, the width of an individual protruding area 260 may be any suitable for its described purpose. Similarly, the length of an individual recessed area 240, 250; non-recessed area; 245, 255 and/or protruding area 260 may be any suitable for its described purpose.

In addition, the depth of the recess defining the grooves 240 on the front side 205 of the panel 170 may be the same or different in relation to the depth of the recess forming the grooves 250 on the back side 210 of the panel. In an embodiment, the grooves 250 of the rear side 210 are deeper (i.e., have a greater depth dimension) than the grooves 240 on the front side 205. For example, the grooves 250 on the rear side 210 may be about 3 mm deep, while the grooves on the front side are about 2 mm deep, resulting in a depth ratio of rear side to front side of 3:2 or 1.5:1. Stated another way, the grooves 240 on the front side 205 extend into the support panel 170 at a depth of up to approximately (+/−5%) 30% the height/thickness of the panel. Similarly, the grooves 250 on the rear side 210 extend into the support panel 170 at a depth of up to approximately 50% (+/−5%) the height/thickness of the panel and, in particular, up to about 75%. By controlling the depth of the recess, it is possible to control not only the degree of expansion/stretch along the groove 240, 250, but the amount of flexure that is permitted by the groove. Specifically, deeper recesses or grooves 240, 250 permit greater degrees of expansion and greater degrees of flexure. Thus, each groove 240, 250 provides a degree of flexure or a flexure zone along the groove as it extends along the side of the panel. This, in turn, permits contouring around each breast, with the panel 170 adapting to each user (i.e., each breast shape). In addition, it is believed that expansion permits movement within defined ranges, permitting the panel to permit motion, but locking out to ensure proper encapsulation. By locking out, the recesses or grooves 240, 250 may assist with directing motion within safe patterns and limits.

In an embodiment, the thickness of the support panel 170 in the non-recess areas is 6 mm, the thickness of the panel in the recessed areas or grooves 240 is 4 mm, the thickness of the panel in the recessed areas 250 is 3 mm, the and the thickness of the panel in the protruding areas is 10 mm. It should be understood, moreover, that the support panel 170 may include a first pattern of grooves on its front side 205 and a second panel of grooves on its second side 210, the groove patterns overlapping each other to provide a cumulative recess at the point of overlap. Thus, when the nominal panel thickness is 6 mm, the depth of the first side groove 240 is 2 mm and the depth of the second side groove 250 is 3 mm, the resulting thickness of the panel at the point of overlap is 1 mm.

With this configuration, areas of differing modulus or flexure may be formed that relate to the thickness of the panel 170 at a particular location. Specifically, each of the recessed areas or grooves 240, 250 define lines of flexure or movement, permitting the panel 170 to readily bend (compared to that of non-recessed areas 245, 255 or protrusions 260). In addition, the recessed areas or grooves 240, 250 may possess greater stretch properties, expanding more easily than the non-recessed areas 245, 255. The deeper the groove (i.e., the thinner the panel is at a particular location), the greater the panel flexes/moves/stretches at that location. Conversely, protruding areas 260 possess less stretch than normal, non-protruding areas. Accordingly, by organizing the grooves along the support panel 170 in a predetermined pattern it is possible to direct the fit and support of the support panel, guiding its contouring along the user, as well as the degree of support generated via limiting stretch and bend. As noted above, one or both sides of the support panel 170 may include groove pattern configured to provide a predetermined fit and/or support to the wearer.

Apertures or perforations 265 may extend completely through the panel 170, extending from the front side 205 to the rear side 210. The perforations 265 extending through the panel 170 are located at a variety of locations along each side of the panel. Accordingly, some perforations 265 extend through the panel 170 to the rear side 210 at grooves 250A, 250B, 250C and also at ridges 350A, 350B, 350C. The perforations 265 facilitate a flow of air through the panel 170 to provide or enhance a cooling effect for the bra during use.

Figure 5A:
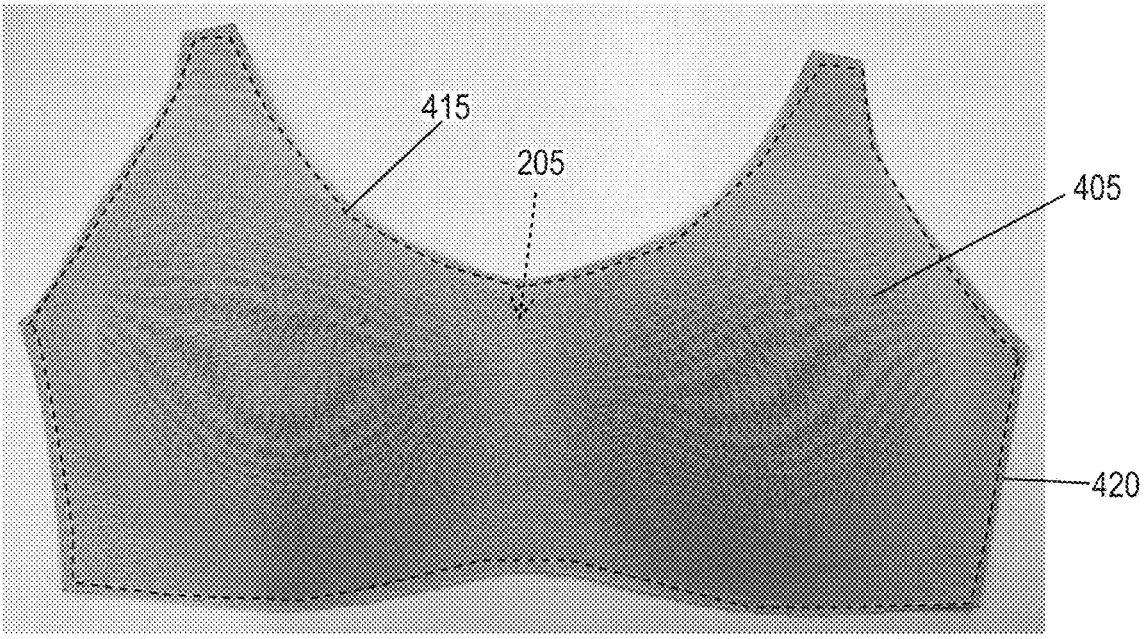
FIG. 5A shows the support panel of FIG. 2A further including an outer textile layer.
Figure 5B:
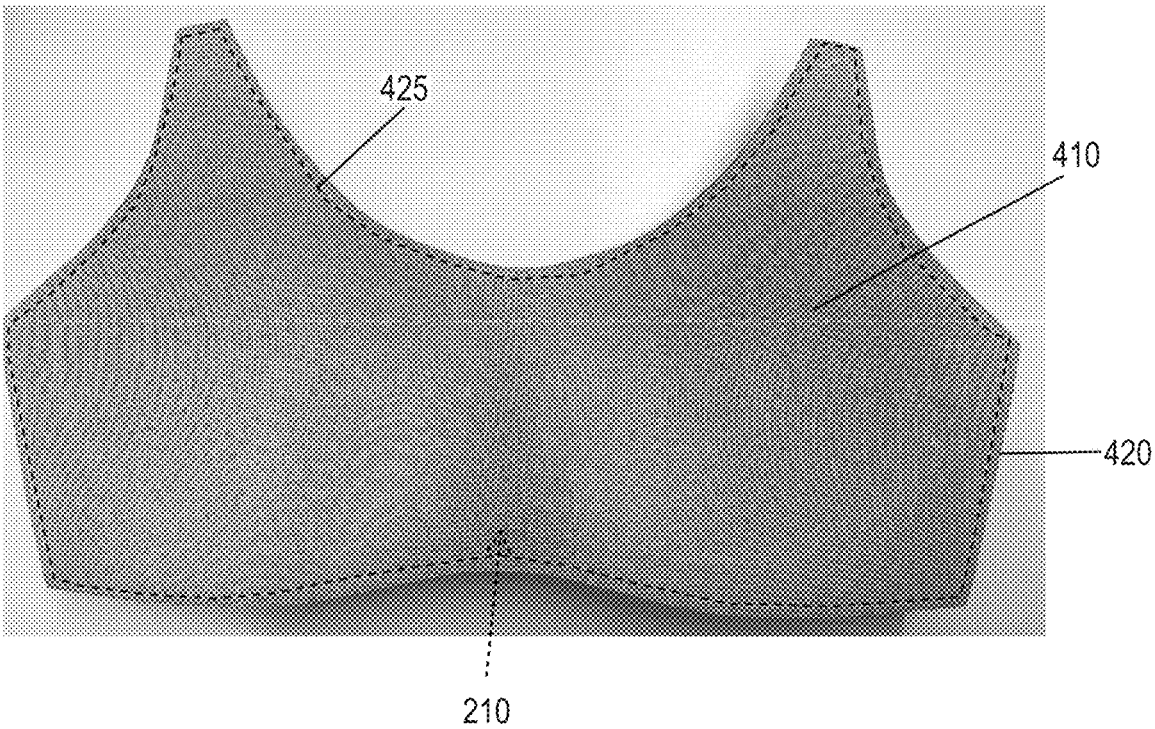
FIG. 5B is the support panel of FIG. 2B further including an outer textile layer.

In an embodiment, each side 205, 210 of the panel 170 may be covered with a protective textile layer. Referring to FIGS. 5A and 5B, a first or front textile layer 405 is coupled to the panel front side 205 and a second or rear textile layer 410 is coupled to panel rear side 210. The textile is resilient to permit (and/or to not interfere with) the stretching and flexure of the panel 170. By way of example, the textile may possess a stretch value of at least 50% or a stretch value of at least 100%. The fabric may further be breathable to permit the flow of air therethrough. In an embodiment, the textile is a resilient fabric such as mesh fabric of synthetic yarns. The textile layers 405, 410 can further comprise the outer textile layer 160 and the inner textile layer 165 or, alternatively, comprises separate textile layers.

The textile layers 405, 410 are generally coextensive with its associated side 205, 210. The textile layers 405, 410, moreover, are secured to the panel (the sides 205, 210) to permit (not interfere with) the flexure and/or stretching of the panel, particularly along the grooves. As shown the first fabric is coupled (e.g., attached) to the panel first or front side 205 via stitching 415 proximate (along) the perimeter or perimetral edge 420 of the panel. Similarly, the second textile 410 is coupled (e.g., attached) to the second or rear panel side 210 via stitching 425 proximate (along) the perimeter or perimetral edge 420 of the panel. In an embodiment, the stitching 415, 425 is located inboard no more than five mm (e.g., 4 mm) from panel outside edge 420. In a further embodiment, the stitching 415, 425 is located no more than 10 mm from the edge 420.

The remainder or a substantial portion (e.g., at least 90% of the surface area) of one of both of the textile layers 405, 410 may be left unsecured or uncoupled to the panel side 205, 210. That is, the textile 405, 410, instead of being laminated to the panel via an adhesive (applied, e.g. via spraying), the fabric is tethered to the panel, along its perimeter. With this configuration, the strands of the textile are not adhered to the surface of the panel 170 and, as such, the textile 405, 410 is not continuously bonded to the panel. Substantially all of the textile remains unattached, being separable/disconnected from the panel, particularly within the grooved areas. In a further embodiment, one textile layer (e.g., the front textile layer 405) is secured via perimeter stitching such that the area spanning the support panel is unbonded/free floating, while the other textile layer (e.g., the rear textile layer 410) is continuously bonded to the support panel via adhesive, being laminated thereto. Minimizing bonding of the textile via adhesive across the surface of the panel minimizes interference with movement of the panel such as stretch and/or flexure.

While both the first textile 405 and the second textile 410 may be tethered to its associated panel side 205, 210 via stitching, it should be understood that one textile may be secured to its corresponding side (e.g., the second textile 410 secured to rear panel side 210) utilizing lamination, where an adhesive is applied (e.g., via spraying) along the surface of the panel to bond substantially all of the textile strands to the panel surface.

The female breast lies over the pectoralis major muscle and is primarily made of glandular tissue and fat. Within the breast are ligaments that, along with the skin, are believed to provide minimal natural support to the breast. Due to this weak natural support, movement of the upper body causes independent movement of the breast. During exercise, the torso moves in many different directions at different speeds. With limited internal support, breast motion is driven by the motion of the torso. For example, during an activity such as running, it is believed that each breast moves independently in three dimensions (up/down, forward/back, side-to-side). Reducing this movement will reduce breast pain, reduce the risk of long-term breast sag and reduce barriers to physical activity participation for women.

Conventional bras, however, generally seek to reduce only the up and down movement. Additionally, conventional bras with a pad for each bra do not encourage guiding breast motion, e.g., permitting limited motion in multiple directions and/or direction that motion along less damaging vectors. The present, monolithic or unitary pad or support panel, while still permitting several degrees of motion, still prevents (reduces) motion of each breast along each axis. In particular, control of breast motion is enhanced at least in part due to the configuration of the bra described herein, including the panel having the textured front and rear sides with the grooves and corresponding ridges in the patterns as described herein to provide flexure areas or zones at and around the cup locations of the bra.

The present configuration may further permit each breast to independently move as a discrete mass (conventional bras and cups often treat the breasts as a combined singular mass), providing comfort to the wearer particularly during strenuous or high impact activities such as sports. Since each cup 225, 230 is able to conform over each breast, even when the breasts may not be symmetrical, the panel 170 is still able to encapsulate and support, each cup slowing the acceleration of the breast via expansion/contraction along the grooves. Accordingly, the degree of movement from an equilibrium position experience by each breast is reduced, improving comfort and avoiding pain experienced by the wearer.

Example Test

To collect breast motion data, six motion sensors were applied directly to participants' breast and body and secured with hypoallergenic tape. Two sensors were applied to the breast and four were applied to the front and back of the upper body. Breast and body movement was measured in three dimensions (forwards/backwards, side/side and up/down). Breast and body movement was assessed during treadmill running at 10 km/hr, and relative breast movement was calculated. This process was followed for (1) no bra worn and (2) the bra of the invention, including the grooved panel described above. The percentage of breast movement reduction the bra provide was calculated for each direction (forwards/backwards, side/side and up/down) and for overall breast movement.

When comparing the percentage reduction of forwards/backwards breast movement of the sports bras tested, the sports bra as described herein reduced overall breast movement 68%, with forwards/backwards breast movement being reduced by 60%, side/side breast movement being reduced 80%, and up/down breast movement reduced by 68%.

As the above test data show, the present invention was effective in not only reducing upward and downward motion, but also side-to-side and backwards motion. While the invention has been described in detail and with reference to specific embodiments thereof, it will be apparent to one skilled in the art that various changes and modifications can be made therein without departing from the spirit and scope thereof. For example, the depths of the front side grooves 240 may differs from the depth of the rear side grooves 250. It should be understood, however, that the grooves along the front and rear sides of the panel may be recessed into the panel at the same depth. In addition, the grooves along the front may be recessed deeper than the grooves on the back. In other embodiments, either the groove panel on either the front or rear side may be omitted. Additionally, while the groove patterns may differ, they may also be the same or similar.

It is intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration.

What is claimed:

1. An athletic bra comprising:

a molded support panel defining a first panel side, a second panel side, and a perimetral edge, the panel including:

a first cup comprising a convex section at the first panel side and a concave section at the second panel side, and a second cup comprising a convex section at the first panel side and a concave section at the second panel side;

a flexure groove formed into the second panel side and extending continuously along the second panel side from the first cup concave section to the second cup concave section, the flexure groove defining a flexure zone for the athletic bra; and a plurality of intersecting grooves formed into the first panel side, wherein the intersecting grooves formed into the first panel side extend continuously from the first cup convex section to the second cup convex section.

2. The athletic bra of claim 1, further comprising a plurality of flexure grooves extending continuously along the second panel side from the first cup concave section to the second cup concave section.

3. The athletic bra of claim 1, wherein the flexure groove comprises a first flexure groove including a first curved section at the first cup concave section and a second curved section at the second cup concave section.

4. The athletic bra of claim 3, further comprising:

a second flexure groove formed into the second panel side and extending continuously along the second panel side from the first cup concave section to the second cup concave section, the second flexure groove including a third curved section at the first cup concave section and a fourth curved section at the second cup concave section.

5. The athletic bra of claim 4, further comprising a ridge defined along the second panel side between the first flexure groove and the second flexure groove, the ridge extending continuously along the second panel side from the first cup concave section to the second cup concave section.

6. The athletic bra of claim 4, wherein the first and second flexure grooves are aligned in a nested configuration with each other.

7. The athletic bra of claim 6, wherein the third curved section of the second flexure groove is nested within the first curved section of the first flexure groove at the first cup concave section, and the second curved section of the first flexure groove is nested within the fourth curved section of the second flexure groove at the second cup concave section.

8. The athletic bra of claim 1, wherein the flexure groove formed into the second panel side has a depth that is greater than a depth of each groove formed into the first panel side.

9. The athletic bra of claim 1, further comprising a plurality of perforations extending through the panel, wherein some of the perforations are within the flexure groove.

10. The athletic bra of claim 1, further comprising:

a textile layer secured to the first panel side, the textile layer secured to the panel proximate the perimetral edge of the panel.

11. The athletic bra of claim 10, wherein the textile layer is secured only at the perimetral edge of the panel such that at least 90% of a surface area of the textile layer is unsecured to the first panel side.

12. The athletic bra of claim 1, wherein the panel is formed of foam.

13. The athletic bra of claim 1, wherein the panel varies in thickness along a lengthwise dimension and/or a widthwise dimension from about 2 mm to about 4 mm.

14. The athletic bra of claim 1, further comprising:

a main body portion, the main body portion including a pocket disposed between layers of the main body portion;

wherein the pocket is sufficiently dimensioned to secure the panel between the layers of the main body portion.

15. The athletic bra of claim 1, wherein each of the intersecting grooves formed into the first panel side possesses a first depth, and the flexure groove formed into the second panel side possesses a second depth that differs from the first depth.

16. The athletic bra of claim 15, wherein the second depth is greater than the first depth.

17. An athletic bra comprising:

a molded support panel defining a first panel side, a second panel side, and a perimetral edge, the panel including:

a first cup comprising a convex section at the first panel side and a concave section at the second panel side, and a second cup comprising a convex section at the first panel side and a concave section at the second panel side;

a first flexure groove formed into the second panel side and extending continuously along the second panel side from the first cup concave section to the second cup concave section, wherein the first flexure groove defines a flexure zone for the athletic bra and includes a first curved section at the first cup concave section and a second curved section at the second cup concave section; and a second flexure groove formed into the second panel side and extending continuously along the second panel side from the first cup concave section to the second cup concave section, the second flexure groove including a third curved section at the first cup concave section and a fourth curved section at the second cup concave section;

wherein:

the first and second flexure grooves are aligned in a nested configuration with each other; and the third curved section of the second flexure groove is nested within the first curved section of the first flexure groove at the first cup concave section, and the second curved section of the first flexure groove is nested within the fourth curved section of the second flexure groove at the second cup concave section.

18. The athletic bra of claim 17, further comprising:

a plurality of grooves formed into the first panel side, wherein each of the grooves formed in the first panel side possesses a first depth, and each of the first and second flexure grooves formed in the second panel side possesses a second depth that differs from the first depth.

19. The athletic bra of claim 18, wherein the second depth is greater than the first depth.

20. The athletic bra of claim 17, wherein the panel is formed of foam.

* * * * *